United States Patent [19]

Lichfield et al.

[11] Patent Number: 4,567,926

[45] Date of Patent: Feb. 4, 1986

[54] APPARATUS FOR AND METHOD OF DISPENSING BULK LIQUIDS

[75] Inventors: William H. Lichfield, Corinne; E. Brent Cragun, Ogden, both of Utah

[73] Assignee: Carb-A-Drink International, Inc., Salt Lake City, Utah

[21] Appl. No.: 569,530

[22] Filed: Jan. 9, 1984

[51] Int. Cl.[4] ..... B65B 39/00

[52] U.S. Cl. ..... 141/332; 141/1; 141/392

[58] Field of Search ..... 141/1, 2, 18, 97, 98, 141/297-300, 311, 312, 331-345, 369-372, 391, 392; 222/460, 461, 566, 567

[56] References Cited

U.S. PATENT DOCUMENTS

| | | | |
|---|---|---|---|
| 60,344 | 12/1866 | Devoe | 141/95 |
| 545,915 | 9/1895 | Russell | 141/332 |
| 679,295 | 7/1901 | Chandler | 222/25 |
| 1,521,928 | 1/1925 | Campbell | 141/372 X |
| 2,536,419 | 1/1957 | Brunell | 141/341 |
| 2,623,523 | 12/1952 | Benson | 128/253 |
| 2,812,117 | 11/1957 | Butkus et al. | 141/311 X |
| 2,827,931 | 3/1958 | Melvin | 141/331 |
| 2,934,243 | 4/1960 | Metzger | 222/145 |
| 3,193,143 | 7/1965 | Maieli | 222/42 |
| 3,200,997 | 8/1965 | Creswick | 141/369 X |
| 3,289,948 | 12/1966 | Fuerst | 239/406 |
| 3,732,734 | 5/1973 | Avakian | 73/425.6 |

FOREIGN PATENT DOCUMENTS

| | | | |
|---|---|---|---|
| 881973 | 5/1943 | France | 141/331 |

*Primary Examiner*—Stephen Marcus
*Assistant Examiner*—Ernest G. Cusick
*Attorney, Agent, or Firm*—George H. Mortimer

[57] ABSTRACT

A self-service system for refilling customer furnished bottles from bulk storage. The system is designed for small neck bottles and includes a nozzle or an attachment that is too large to be received in a bottle neck and a detachable funnel that is loosely suspended below the nozzle. The apex discharge of the funnel is sized to be received in the bottle neck.

11 Claims, 5 Drawing Figures

APPARATUS FOR AND METHOD OF DISPENSING BULK LIQUIDS

INTRODUCTION

This invention relates generally to dispensing of beverages from bulk supply to customers' bottles and in particular to methods and systems for dispensing beverages into refillable containers.

BACKGROUND OF THE INVENTION

In recent years the carry out merchandising of food and drink has trended away from factory packaging toward on-site dispensing from bulk containers into smaller containers. Further, the trend in beverage dispensing is toward customer-furnished refillable containers.

Potable beverages, such as milk, syrups, juices and carbonated beverages are furnished in throwaway cartons, cans or bottles or returnable bottles that are cleaned and refilled at a factory. For on-site consumption such beverages are dispensed by employee through suitable nozzles into glasses, being mixed, as needed, in the nozzle or glasses. The employees may also fill customer-furnished containers.

From the standpoint of cost and consumer convenience the provision of ways and means for the self-service dispensing of beverages in stores and markets into relatively large reusable containers brought in by customers will effect considerable savings. However, there are some problems to be overcome in order to achieve this goal. First, in existing systems where the customer furnishes the container and fills it himself, the dispensing station has no control over cleanliness of the container or the filling procedure used, and there is no way to block contact between the container and the dispensing nozzle. As a consequence, the dispenser may become contaminated. Second, the small necked bottles used for carbonated beverages are impossible to fill without a lot of splashing unless the nozzle fits into the bottle or a funnel is used. Fitting nozzles into bottles is unsanitary and physically damaging to equipment. Funnels heretofore in use are made of metal and are unsanitary, hand held, cumbersome, inconvenient to handle, hard to clean and often nick or otherwise damage both the dispenser nozzle and the bottle.

Many bulk dispensers for beverages exist and are well known. The present invention is a method of and a system for adapting both new and existing dispensers to self-service refilling of customer-furnished bottles, while providing the desired sanitation, convenience and avoiding damage to equipment, which fills a real need for the public.

OBJECTS AND SUMMARY OF THE INVENTION

It is the principal object of this invention to provide ways and means adapting existing bulk liquid dispensers to self-service filling of bottles, especially small neck bottles.

Another object is the provision of ways and means for self-service filling of bottles which protect the dispenser against direct contact with the bottle being filled, thereby avoiding contamination and damage.

A related object is the provision of a nozzle adapter in the system that blocks insertion of the nozzle into a bottle thereby requiring use of a sanitary disposable funnel to fill a bottle with beverage dispensed through the nozzle. The use of the funnel permits the nozzle and container to be spaced apart far enough to assure no contact between the bottle neck and nozzle.

A further object is the provision of ways and means achieving the foregoing objects which means are easily inserted into the system for use or removed therefrom for replacement.

Still another object is the provision of ways and means including the use of a sanitary disposable funnel element located during a filling operation between the dispenser nozzle and bottle which enables them to be spaced apart, thereby to prevent contact therebetween while funneling liquid into the bottle without splash; and means are provided for loosely holding said funnel in operative position with respect to the dispenser nozzle to enable insertion and removal of bottles into and from the filling position.

In accordance with the present invention, the foregoing and other objects are achieved by provision of a hanger that is attachable to the dispenser nozzle, means on the hanger for slidably supporting a funnel, and a sanitary, disposable funnel adapted to be placed in said hanger and cooperative therewith to be positioned to receive beverage dispensed from said dispenser nozzle and direct it into a bottle.

It is an important function and result of the invention to cause the customer to follow a specific self-service technique that achieves the sanitation object of the invention.

In accordance with the preferred embodiment of the invention, the hanger is shaped to cover the outer shell of the dispenser nozzle thereby to protect the latter against physical damage. A spring-like clip is provided on the hanger to hold a lightweight, sanitary, disposable paper funnel. The funnel should have a rolled upper edge and the clip should be a spring clip with a small inside ridge or projection at the free end of the clip to space it from the outer wall of the hanger far enough to permit free sliding movement of the rolled edge or similar lip surrounding the larger end of the funnel up and down in the space between the arm and the surface of the hanger but to be prevented from falling out by the ridge or projection the funnel edge. The hanger shell and clip may be made of any suitable material, preferably a food-grade plastic. In connection with the hanger, the slip-on friction holding cover is very useful because it holds itself in place and covers the entire nozzle thus providing physical protection. Also, since it simply fits on as a cover, no special connectors are needed to secure it to the station. The clip for holding the funnel is fastened to the cover.

The shape of the cover is important. It is made wide enough at the outlet so that neither the nozzle nor the cover outlet can be inserted into the bottle neck. This forces the user to employ a funnel for the filling operation. The size relationship is that the outlet or lower end of the funnel is smaller in diameter than the diameter of the cover and the neck of the bottle while the cover adjacent the outlet is larger than the neck of the bottle and/or the funnel outlet opening.

In the preferred embodiment, the hanger is formed so that when in place over the nozzle it is held thereon by friction. The funnel is engaged by the clip and is loosely and slidably suspended therebelow.

The shell protects the nozzle against contamination and damage by contact yet is easily removed for periodic cleanup. It also forces the user to resort to a funnel for filling. The funnel provides a sanitary disposable spacer to keep the bottle away from the nozzle yet at the same time provide the necessary connection between the nozzle and bottle top to direct beverage into the bottle.

By loosely suspending the funnel, positioning of the funnel and a bottle for filling is facilitated and may be accomplished without touching the nozzle with hands or bottle. Also, the hanger clip will properly position the funnel outlet in the filling opening of a container to direct flow through the funnel and into the mouth of a container.

In the operating sequence, as shown in the drawings, the funnel is raised, the bottle positioned thereunder and the funnel lowered to insert the neck into the bottle. The station is dimensioned with the nozzle a finite distance above the platform. When a funnel with the nozzle a finite distance above the platform is in place, the usual two liter bottle will not fit under the funnel unless the latter is raised. Once the bottle is positioned the funnel can be lowered, since the nozzle cover is too large for the opening in the neck of the bottle, and if the user is to avoid splash the funnel must be used and manipulated as shown.

The funnels are formed from usual material used for paper or other disposable cups. They are disposable and only one need be used for each customer.

In order that the invention may be more readily understood and carried into effect, reference is made to the appended drawings and accompanying description thereof which are offered by way of example only and not in limitation of the invention, the scope of which is defined by the appended claims, including equivalents, rather than any description.

DETAILED DESCRIPTION

Figure 1:
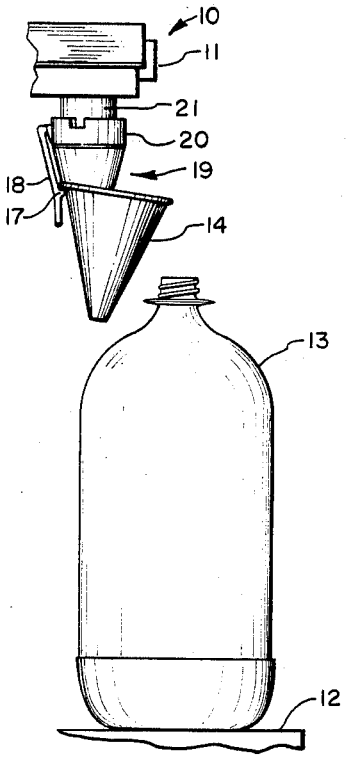
FIG. 1 is a side elevation of a liquid dispensing station embodying the invention illustrating the relationship of components prior to positioning a bottle for filling.

The bulk dispensing apparatus comprises a dispensing nozzle 10 having a push button or similar control 11 and a support 12 for holding a succession of bottles for filling. As is usual, the nozzle dispenses a carbonated beverage that is mixed on-site in the system for syrup, water and $CO_2$ gas. As illustrated, the apparatus shows only a single station with a filling nozzle, but most systems have several filling stations, some of which may have several nozzles. A platform 12 with the usual drain provides support for bottles being filled.

A customers' container, typically a screw-top bottle 13, is put in place under sanitary nozzle, the funnel 14 is inserted with its upper, larger end surrounding the nozzle and its lower, outlet end in the filling opening or mouth of the bottles and the dispensing control pressed. According to the invention, the upper end of the bottle is spaced from the nozzle 10 almost as far as the height of a funnel 14 desirably formed from paper or other inexpensive, hence disposable, material. The funnel which has a wall, a larger upper end surrounded by a rim and a smaller discharge end is formed with a rolled lip 15 on the top rim which is sized to be slidable in the space between and removably held by a latch piece or inwardly directed projection 17 on a clip spring arm 18. The clip or strip which has an upper end and a lower end is affixed at its upper end to the dispensing station by means of a nozzle cover or shell 19 that fits over the nozzle and is held in place thereon by friction, although other means can be employed. For friction fit, a portion 20 of the cover is made to conform snugly to a corresponding portion 21 of the nozzle wall.

The lip 15 of the funnel is easily pushed past the latch piece 17 when the funnel is positioned to encircle the nozzle 10 and slides upwardly in the space between the wall of the shell 19 and the spring arm 18 during positioning of a bottle 13 on support 12. The latch piece 17 then holds the funnel in place as the small end thereof is dropped into the filling opening of the bottle.

The lower or discharge end 23 of the cover 19 has a discharge orifice or port axially aligned with the nozzle. At the discharge end the cover is deliberately made too wide to fit into the neck of the bottle to be filled. This forces the use of the funnel.

Figure 4:
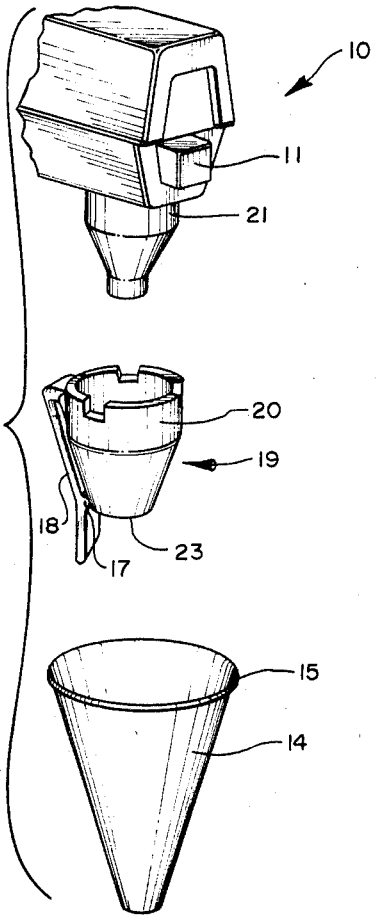
FIG. 4 is an exploded view illustrating the several components of the system.

For periodic cleanup the system will be disassembled into the component parts as shown in FIG. 4. However, to insure each user of fresh sanitary conditions between cleanups a supply of sanitary disposable funnels 14 is kept on hand. Since nozzles are protected by the covers and funnels, each user is assured a completely clean supply system. Even if a customer's bottle is dirty, the disposable funnel makes it possible to design the equipment with sufficient space between the nozzle and the top of the bottle when it is rested on the support 12 to reduce the possibility of accidental contact of the bottle with the nozzle essentially to zero. The avoidance of bottle contact with the nozzle thus protect subsequent customers. Since the cover will not fit into a bottle the user must use a funnel.

Figure 2:
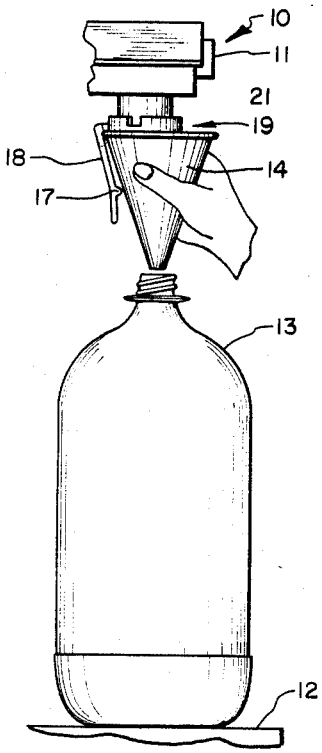
FIG. 2 is a view similar to FIG. 1 but with the components arranged for placing the bottle in filling position preparatory to filling.
Figure 3:
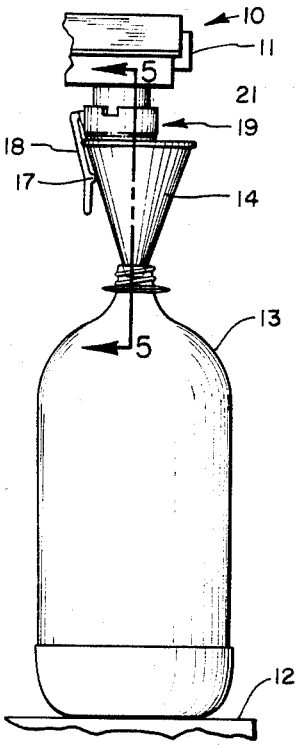
FIG. 3 is a view similar to FIGS. 1 and 2 but with the components in final position to fill the bottle.

As is apparent from FIG. 1, when the system is at rest the small end of the funnel extends slightly below the top surface of the neck of the usual bottle when it is placed in filling position on support 12. To condition the bottle for filling, the funnel is raised and the bottle is moved to filling position therebeneath as in FIG. 2. The funnel is then lowered to insert the lower end into the bottle neck as in FIG. 3, and the filling operation may be started and completed. The loose, slidable suspension of the funnel on the cover facilitates positioning of the bottle because it can accommodate misalignment of the nozzle and the bottle. When the bottle is filled it can be withdrawn and the funnel either be left hanging or discarded. The next user can, of course, insert a new funnel since the old one, if left hanging, is easily removed for discard by a light tug.

Figure 5:
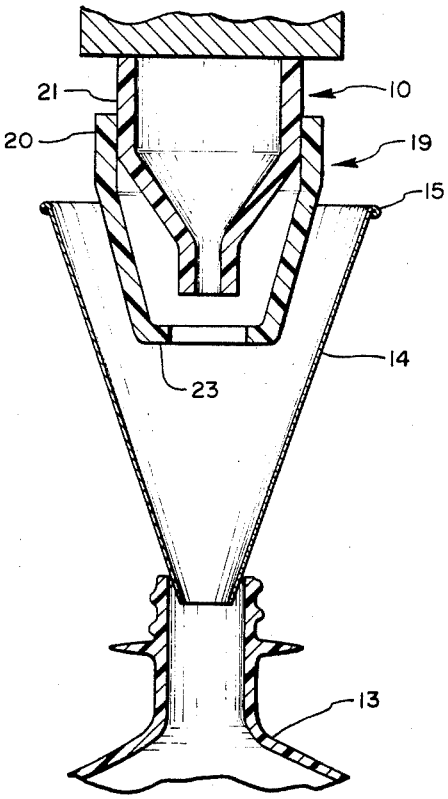
FIG. 5 is a partial side sectional view of the system illustrating in more detail the relationship of the several components and a typical bottle in filling position.

FIGS. 4 and 5 illustrate the relative positions and shapes of the various components. Attention is directed to the relative sizes of the discharge end of the nozzle and the discharge end of the cover 19. The nozzle 10, as illustrated, might fit into the neck of a bottle, but to eliminate the possibility of it being used in this manner, the cover 19 is shaped with a substantially wider bottom surface 23 that presents insertion into the neck of a bottle. Thus, filling can be accomplished only with a funnel which is needed to avoid splash and to insure sanitation and cleanliness.

The invention has been described with reference to the usual conical-shaped funnel with a relatively large open top and a smaller lower apex discharge end. Those skilled in the art will recognized that other funnel shapes may be employed. Also, the funnel may simply comprise a lower and smaller open apex end or an attached neck or tube.

Although a preferred form of my invention has been herein disclosed, it is to be understood that the preferred embodiment disclosed above is by way of example and that variations are possible without departing from the subject matter coming within the scope of the following claims, which subject matter I regard as my invention.

I claim:

1. Apparatus for self-service of beverage into a succession of bottles of predetermined height, each bottle having a filling opening at the top, comprising a station that includes a beverage dispensing nozzle having a discharge outlet and a bottle support secured in fixed position on said station with a predetermined distance therebetween, a removable funnel having a frustoconical wall of predetermined height having a larger end forming a mouth to surround said nozzle and a smaller end forming a discharge opening to enter said filling opening in each successive bottle, said mouth being surrounded by a rim, a hanger secured to said nozzle including connecting means to detachably and slidably secure a succession of funnels to said nozzle with the mouth surrounding said nozzle and the smaller end in the filling opening of a bottle, said predetermined distance being slightly less than the sum of the predetermined height of the take-out bottles to be filled and the predetermined height of the funnels, whereby the larger end of each funnel is in position to receive beverage flowing from the nozzle and the smaller end thereof is in position to discharge beverage into the mouth of a take-out bottle resting on said bottle support.

2. Apparatus according to claim 1 in which said connecting means comprises a vertically arranged elongated spring strip having upper and lower ends and being secured at the upper end to said hanger and terminates at its lower free end adjacent to the outlet of said nozzle and biased toward said nozzle, and the rim of the wall at the larger end of said funnel being removably located in the space between said strip and said hanger.

3. Apparatus according to preceding claim 2 with the addition of a latch piece on the inside wall of the strip adjacent its said free end and there is a cooperative outwardly facing lip on the rim of said wall at said larger end of said funnel.

4. Apparatus according to preceding claim 1 in which said hanger comprises a cover having a wall enclosing said nozzle, a discharge port in said cover axially aligned with said nozzle; a vertically arranged elongated spring strip having upper and lower ends connected at its upper end to said cover to extend along the wall thereof and which is biased toward said cover; and the edge of the wall at the larger end of said funnel is received between said spring strip and said cover above the discharge port of said cover.

5. Apparatus according to preceding claim 1 in which said hanger permits vertical movement of said funnel relative to said nozzle.

6. Apparatus according to preceding claim 1 in which said hanger comprises a cover having a wall enclosing said nozzle and having a discharge port axially aligned with the dispensing outlet of said nozzle, a vertically arranged spring strip having upper and lower ends connected at its upper end to said cover wall to extend therealong and which is biased toward said cover, and the rim surrounding the larger end of the funnel is received between said spring strip and said cover.

7. Apparatus for self-service dispensing of beverage from bulk storage into small necked bottles comprising a platform; a downwardly directed nozzle having a discharge opening located a predetermined distance above said platform; a cover having a wall enclosing said nozzle, said cover having an outlet orifice aligned with said discharge opening in said nozzle; a conical funnel having a wall with a larger upwardly facing open end surrounded by a rim for receiving beverage from said bulk storage through said nozzle and a generally downwardly directed discharge outlet at its smaller lower end, said funnel discharge outlet being smaller in diameter than the diameter of said outlet orifice in said cover; connecting means slidably and detachably securing said funnel with its larger end surrounding said nozzle comprising a vertically arranged elongated spring strip having upper and lower ends with its upper end secured to said cover said outlet orifice so that it extends along the wall of said cover to terminate adjacent said outlet orifice, thereby defining a generally vertical slip space between said cover and said strip, said strip being biased toward said cover; and the rim at the upper end of the wall of said funnel is received in said slip space between said strip and said cover.

8. Apparatus according to claim 7 in which said nozzle is located above said platform a predetermined distance slightly less than the sum of the height of a bottle to be filled and the height of said funnel, whereby the smaller end of said funnel is movable between a distance from said support for the bottle less than said bottle height to one greater than said height.

9. Apparatus for self-service dispensing of beverage from bulk supply to customer's bottles comprising;

(A) a bottle support;

(B) a dispensing nozzle above said support;

(C) a cover having an open upper end surrounding and being frictionally held on said nozzle and a lower end having a discharge orifice therein; and (D) a vertically arranged spring strip having an elongated arm with upper and lower ends secured at its upper end to said cover and extending downwardly along it so as to be resiliently biased toward it; a projection on the inner surface of said arm adjacent to its lower end and to the lower end of said cover to provide a slip space between the cover and the portion of said arm between its connection at its upper end to the cover and the projection at the lower end adapted to receive the upper end of a sanitary, disposable funnel having a wall, an open larger upper end surrounded by a bead and a smaller lower discharge end adapted to be placed in the filling opening at the top of a bottle to be filled when resting on said bottle support, the distance between said bottle support and the lower end of said cover being slightly less than the sum of the height of said bottle to be filled and the height of said funnel.

10. The method of sanitary dispensing of beverage through a nozzle into the filling opening in a succession of customer's bottles, said nozzle including means for supporting a funnel in vertically slidable relation to said nozzle, which comprises:

(A) providing a support for bottles in filing position;

(B) providing a nozzle having a discharge orifice a predetermined distance above said support;

(C) supplying a plurality of sanitary, disposable funnels each having a wall, a larger open upper end surrounded by a rim and a smaller discharge end conveniently located near said filling position, the distance between said support and said discharge orifice being slightly less than the sum of the height of a customer's bottle and the height of said funnels;

(D) taking a funnel from said supply, engaging it in vertically slidable relation to said funnel supporting means with the larger end around the nozzle;

(E) placing a customer's bottle in filling position on said support and inserting the smaller end of said funnel in its filling opening;

(F) actuating flow of beverage through the nozzle and funnel into the bottle;

(G) terminating the flow when the desired quantity of beverage has flowed into the bottle; and (H) removing the filled bottle and the funnel making ready for a repetition of the aforesaid steps (D), (E), (F), (G), and (H).

11. The method according to claim 10 in which each funnel is provided with a bead surrounding the upper end and the nozzle is provided with a cover comprising a vertically arranged clip having an elongated spring arm with upper and lower ends secured at its upper end to said cover with bias toward it and extending down along the cover just below said orifice, an internal projection on the inner surface of the arm adjacent to the lower end of said cover to space the intervening part of the arm from said cover far enough sidably to receive the bead of a funnel, and the bottle filling operation is carried out repetitively by removably attaching a funnel to said cover by placing the bead that surrounds the upper end in said space between the arm and cover above said projection, placing the bottle on said support, sliding the funnel upwardly so that its lower end can be placed over the filling opening of the bottle, permitting the lower end of the funnel to drop into the filling opening, filling the bottle, removing it from the support, and removing the funnel.

* * * * *